US006494507B1

(12) United States Patent
Winkler

(10) Patent No.: US 6,494,507 B1
(45) Date of Patent: Dec. 17, 2002

(54) TRACK ROD

(76) Inventor: Morris B. Winkler, 6111 Bedford Ave., Los Angeles, CA (US) 90056-2014

( * ) Notice: Subject to any disclaimer, the term of this patent is extended or adjusted under 35 U.S.C. 154(b) by 36 days.

(21) Appl. No.: 09/645,411

(22) Filed: Aug. 25, 2000

(51) Int. Cl.[7] ..... E05C 17/18
(52) U.S. Cl. ..... 292/259 R; 292/DIG. 46
(58) Field of Search ..... 292/259 R, 339, 292/343, DIG. 46; 70/209, 94

(56) References Cited

U.S. PATENT DOCUMENTS 2,724,609 A 11/1955 Donnelly
2,844,348 A 7/1958 Jordon
3,347,585 A 10/1967 Chmura
4,036,518 A * 7/1977 Jost ..... 292/339
4,300,796 A 11/1981 Lane
4,792,168 A 12/1988 Kardosh
4,824,154 A 4/1989 Simpson
4,958,867 A 9/1990 Champagne
4,971,374 A 11/1990 Lovell et al.
5,211,041 A * 5/1993 Hsu ..... 70/209
5,685,582 A 11/1997 McCartney

* cited by examiner

*Primary Examiner*—Gary Estremsky
(74) *Attorney, Agent, or Firm*—Sanford Astor

(57) ABSTRACT

An adjustable sliding door and window track rod comprising an elongated hollow rod into which a dowel fits telescopically, the dowel having a plurality of alternating slots and raised teeth, a locking pin, which frictionally fits into the hollow tube, and has a central bore through which passes the dowel. A locking clip fits over the locking pin and engages the teeth of the dowel, locking the dowel from moving into or out of the hollow rod, fixing the length of the track rod.

13 Claims, 3 Drawing Sheets

TRACK ROD

TECHNICAL FIELD

The invention relates to the field of door and window stops.

BACKGROUND ART

Theft from homes is a major problem in society today. One particularly vulnerable location in a home is any sliding glass door or window. They are easily broken and the door or window slid open. Also, homeowners often desire to leave the door or window open for ventilation purposes. In doing so, no security exists, as there is no method to secure the open door or window, which can easily be slid further open and the home entered by unwanted persons.

Existing technology for door and window stops exist but suffer from the problem of being unstable and not strong enough to be safe. Examples of such stops are described in U.S. Pat. 4,792,168 and 4,971,374. These stops, while usable to adjustably hold a door closed, or to allow it to be open somewhat, are adjustable by placing pins through one of a series of holes in the device. These pins can be easily lost or broken, so that the devices shown are not secure. In addition lining up the holes in which to place the pins can be a frustrating or difficult experience.

DISCLOSURE OF INVENTION

Applicant's track rod is a sliding door and window stop that can be adjusted to fit any standard size sliding door or window. The track rod can be adjusted for an opening to allow for ventilation while still keeping the sliding door or window from being opened any further. The track rod is fully adjustable and yet locks to any length, in a manner which makes it very secure and extremely difficult to break or defeat. The track rod is preferably made of high-impact Acrylonitryl-butadyene-styrene (ABS) and polyvinyl chloride (PVC) plastic that can withstand up to 3,500 pounds of lateral pressure. In addition, it withstands the deteriorating effects of heat, sunlight and ultraviolet light, will not rust or warp and is designed to fit any standard sliding door or window track. No tools are required for installation. The hollow tubing is best manufactured from PVC, the dowel and the other connecting parts, from ABS.

OBJECTS OF THE INVENTION

Accordingly, objects and advantages of the invention are as follows:

It is an object of the present invention to provide a fully adjustable door or window stop which is strong, secure and easily installed.

It is a further object of the invention to provide a fully adjustable door and window stop that is easily adjustable, durable and provides security for the homeowner.

MODES FOR CARRYING OUT THE INVENTION

Figure 1:
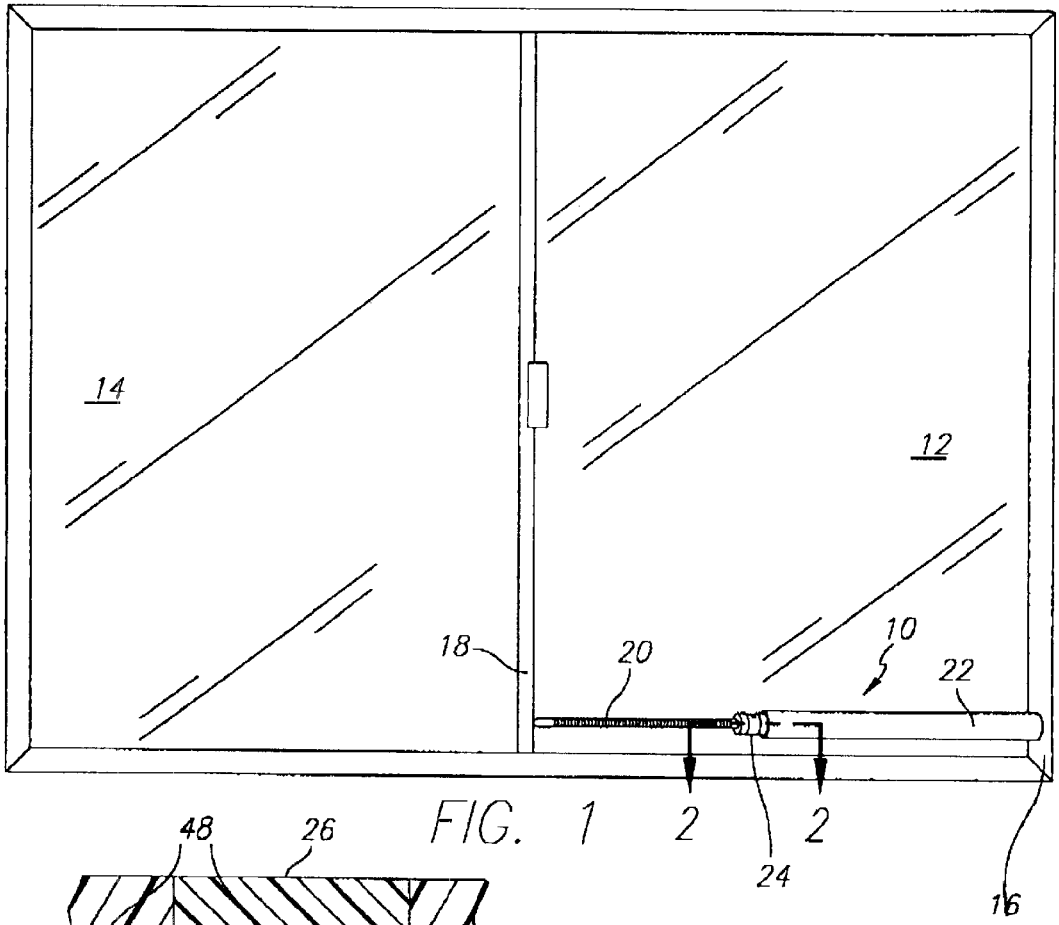
FIG. 1 is a front view of the track rod of this invention in place in a sliding glass door.
Figure 2:
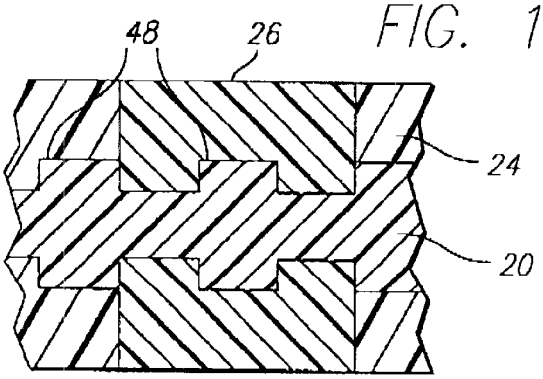
FIG. 2 is a cross-section taken on lines 2—2 of FIG. 1.
Figure 3:
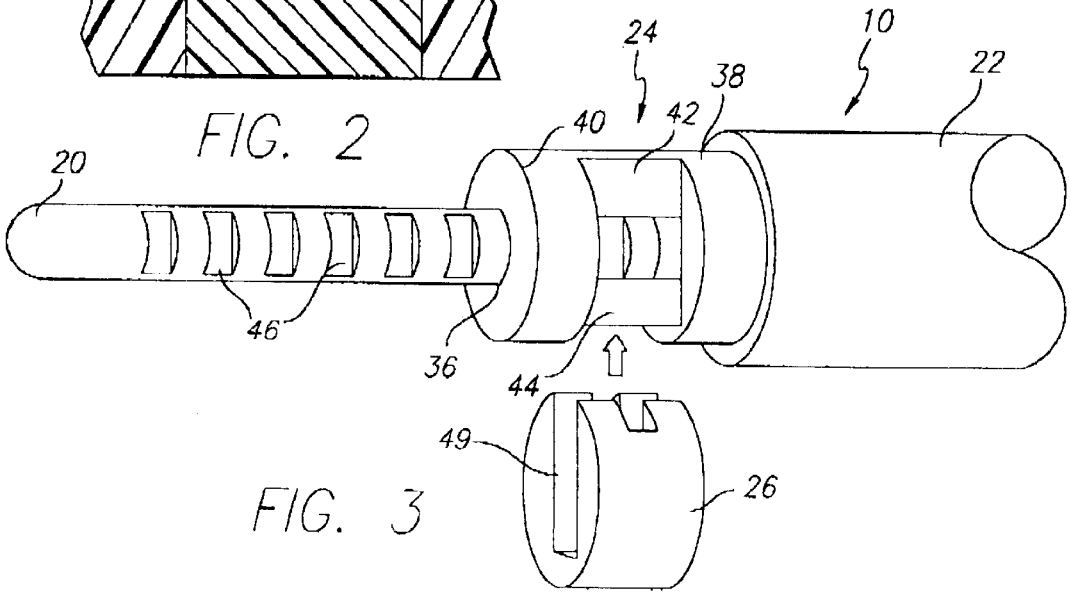
FIG. 3 is a front view of the locking mechanism.
Figure 4:
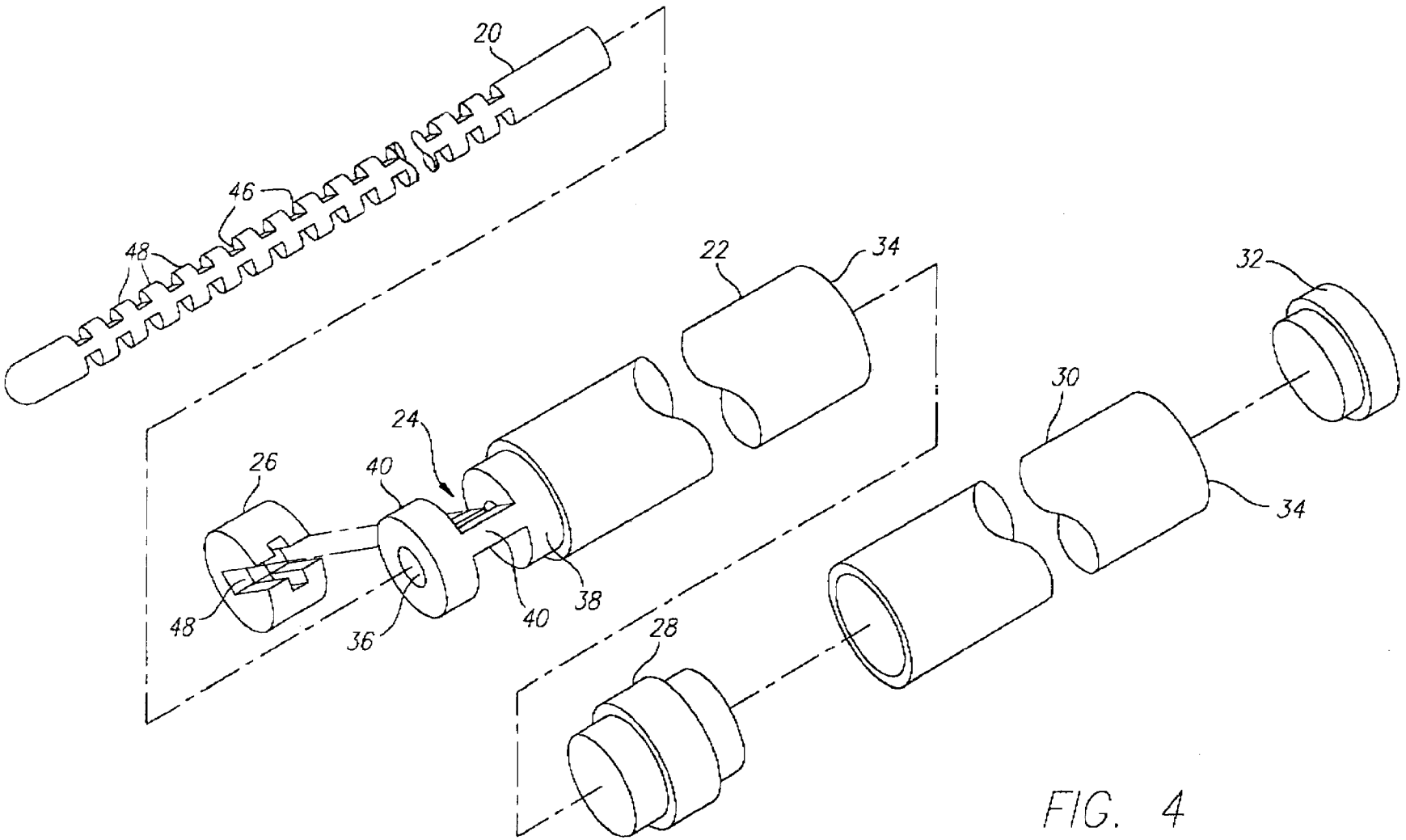
FIG. 4 is an exploded view of the track rod.

Referring now to FIGS. 1–4, there is shown the track rod 10 of this invention located in a sliding glass door which comprises the fixed pane 12 and the sliding door 14. Track rod 10 is placed between the frame 16 of pane 12 and the front edge 18 of door 14.

Track rod 10 comprises dowel 20, hollow rod or tube 22, locking pin 24 and locking clip 26. Coupler 28 is optionally utilized to attach hollow rod section 30 to hollow rod section 22, combining two sections of hollow rod together to lengthen the track rod if needed. Removable end cap 32 is placed on the end 34 of rod 30, or if only one rod is needed, on end 34 of rod 22.

Dowel 20 is just slightly smaller in diameter than circular bore or opening 36 through the center of locking pin 24. Dowel 20 telescopes, that is, passes completely through locking pin 24 and into hollow rod 22. This is accomplished by locking pin 24 comprising two circular or annular portions 38 and 40 connected by two rectangular cross-strips 42 and 44, leaving sufficient room through the center or bore 36 of locking pin 24 for the passage of dowel 20.

Dowel 20 has a plurality of evenly spaced indentations 46, such as every ¼ inch, creating a plurality of raised steps or teeth 48. Locking clip 26 has an elongated opening 49, adapted to receive rectangular cross-strips 42 and 44 of locking pin 24. In doing so, locking clip 26 locks into place over raised step 48 of dowel 20, thus locking dowel 20 into place in locking pin 24 and hollow rod 22. Locking clip 26 has a friction fit onto locking pin 24, making the entire track rod 10 a tightly fit together unit when assembled. Prior to setting locking clip 26, dowel 20 is telescoped to the proper length desired, depending on whether door 14 is to be locked in the fully closed position or track rod 10 will be shortened if the door is to be opened any desired distance.

Track rod 10 can be adjusted, as shown, for a small or large opening to allow for ventilation, or other purposes, while still preventing the sliding door or window from being opened any further. The track rod is fully adjustable and yet locks to any length in a manner which makes it very secure and extremely difficult to break or defeat. As stated, the track rod is preferably made of high-impact ABS and polyvinyl chloride (PVC) plastic that can withstand up to 3,500 pounds of lateral pressure. It can also be made of metal, such as aluminum or steel, or wood. No tools are required for installation.

Figure 5:
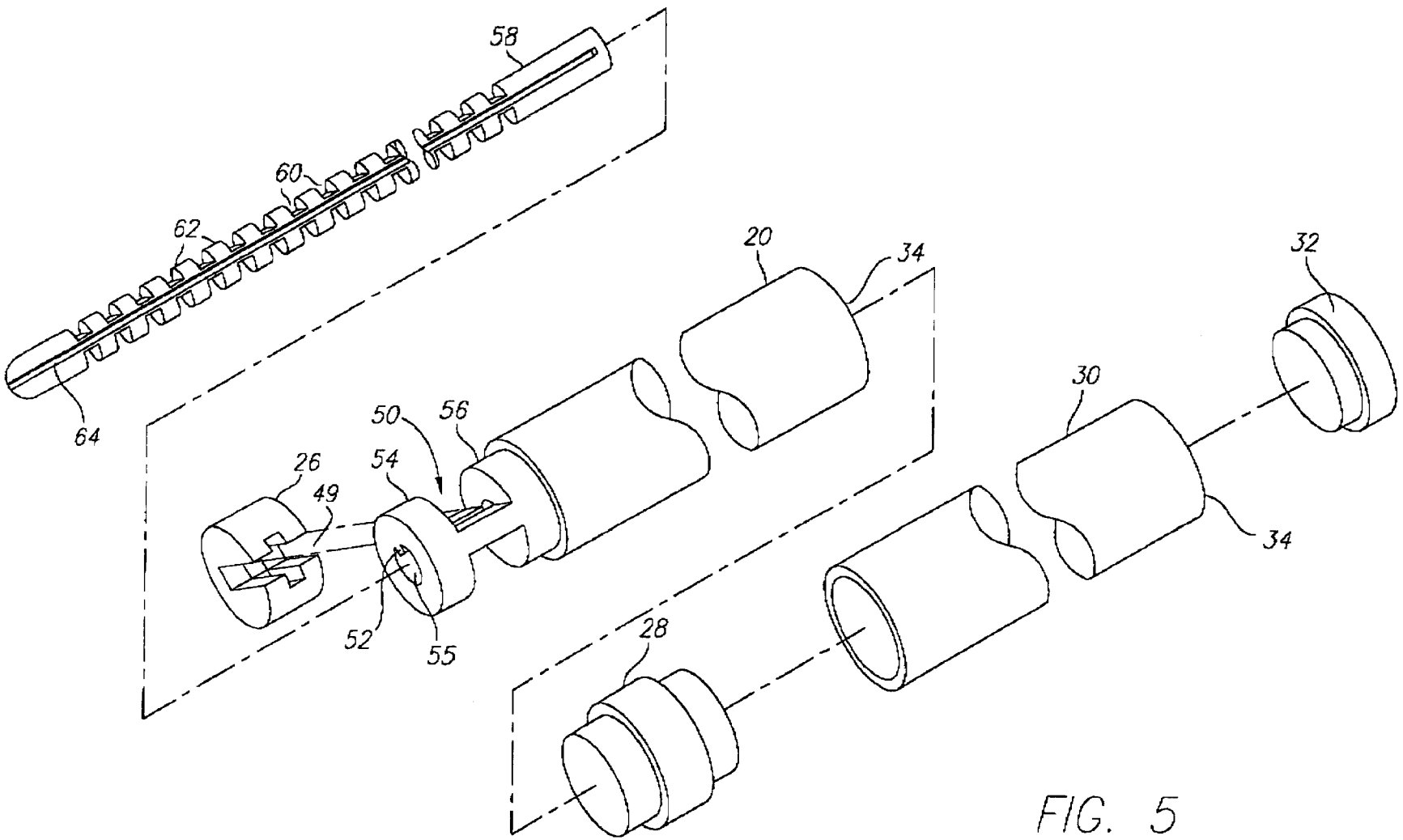
FIG. 5 is an exploded view of an alternate embodiment of the invention.

FIG. 5 shows an alternate embodiment of the track rod of this invention which provides even more stability. In this instance, locking pin 50 has a longitudinal rail 52 protruding down from its annular sections 54 and 56, extending into its central bore 55. Dowel 58, which has indentations 60 and teeth 62, has a matching slot 64 passing longitudinally down its entire length. Rail 52 engages slot 64 as dowel 58 is passed through bore 55 of locking pin 50 which keeps dowel 58 further locked in position, providing an even tighter, more secure unit. In all other respects, this unit operates in the same manner as the embodiment shown in FIGS, 1–4.

Having thus described the invention, I claim:

1. An adjustable sliding door and window track rod comprising an elongated hollow tube, a solid dowel which fits telescopically into the hollow tube, the dowel having a plurality of teeth, a locking pin which is attached to one end of the hollow tube, a locking clip which fits over the locking pin and engages the teeth of the dowel, locking the dowel from moving longitudinally in the hollow tube, in which the hollow tube is made of PVC and the dowel and other parts are made of ABS.

2. An adjustable sliding door and window track rod comprising an elongated hollow tube, a solid dowel which fits telescopically into the hollow tube, the dowel having a plurality of teeth, a locking pin which is attached to one end of the hollow tube, a locking dip which fits over the locking pin and engages the teeth of the dowel, locking the dowel from moving longitudinally in the hollow tube, further comprising a coupler adapted to attach two hollow tubes together.

3. An adjustable sliding door and window track rod comprising an elongated hollow tube, a dowel which fits telescopically into the hollow tube, the dowel having a plurality of teeth, a locking pin which fits into the hollow tube, a locking clip which fits over the locking pin and engages the teeth of the dowel, locking the dowel from moving longitudinally in the hollow tube, in which the locking pin has a longitudinal rail adapted to engage a longitudinal slot in the dowel.

4. An adjustable sliding door and window track rod comprising an elongated hollow tube, a solid dowel which fits telescopically into the hollow tube, the dowel having a plurality of teeth, a locking pin which is attached to one end of the hollow tube, a locking clip which fits over be locking pin and engages the teeth of the dowel, locking the dowel from moving longitudinally in the hollow tube, in which the locking pin comprises two annular portions connected by two rectangular cross-strips.

5. The device of claim 4 which the locking clip frictionally engages the teeth of the dowel and the locking pin rectangular cross-strips.

6. An adjustable sliding door and window track rod comprising an elongated hollow tube, a solid dowel which fits telescopically into the hollow tube, the dowel having a plurality of evenly spaced teeth, a locking pin which is attached to one end of the hollow tube, the locking pin having two annular portions connected by two rectangular cross strips, a locking clip which frictionally fits over the rectangular cross strips of the locking pin and engages the teeth of the dowel.

7. The device of claim 6 further comprising a coupler adapted to attach two hollow tubes together.

8. The device of 6 further comprising an end cap removably attached on the end of the hollow tube opposite to the locking pin.

9. An adjustable sliding door and window track rod comprising an elongated hollow tube, a dowel which fits telescopically into the hollow tube, the dowel having a plurality of evenly spaced teeth, a locking pin which is attached to one end of the hollow tube, the locking pin having two annular portions connected by two rectangular cross strips, a locking clip which frictionally fits over the rectangular cross strips of the locking pin and engages the teeth of the dowel, in which the locking pin has a longitudinal rail extending into its central bore, adapted to engage a longitudinal slot in the dowel.

10. An adjustable sliding door and window track rod comprising an elongated hollow tube, a solid dowel which fits telescopically into the hollow tube, the dowel having a plurality of evenly spaced teeth, a locking pin which is attached to one end of the hollow tube, the locking pin having two annular portions connected by two rectangular cross strips and a central bore through which the dowel passes, a locking clip which frictionally fits over the rectangular cross strips of the locking pin engaging the teeth of the dowel and the rectangular cross strips, preventing the dowel from moving.

11. The device of claim 10 further comprising a coupler adapted to attach two hollow tubes together.

12. The device of 10 further comprising an end cap removably attached on the end of the hollow tube opposite to the locking pin.

13. An adjustable sliding door and window track rod comprising an elongated hollow tube, a dowel which fits telescopically into the hollow tube, the dowel having a plurality of evenly spaced teeth, a locking pin which frictionally fits into the hollow tube, the locking pin having two annular portions connected by two rectangular cross strips and a central bore through which the dowel passes, a locking clip which frictionally fits over the rectangular cross strips of the locking pin engaging the teeth of the dowel and the rectangular cross strips, preventing the dowel from moving, in which the locking pin has a longitudinal rail extending into its central bore, adapted to engage a longitudinal slot in the dowel.

* * * * *